US012780276B2

(12) United States Patent
King

(10) Patent No.: US 12,780,276 B2
(45) Date of Patent: Nov. 3, 2026

(54) METHODS AND SYSTEMS FOR ENERGY EFFICIENT ROUTE PLANNING AND CONTROL STRATEGIES FOR SELF-PROPELLED RAILWAY VEHICLES

(71) Applicant: Intramotev Inc., St. Louis, MO (US)

(72) Inventor: Samuel David King, O'Fallon, IL (US)

(73) Assignee: Intramotev Inc., St. Louis, MO (US)

( * ) Notice: Subject to any disclaimer, the term of this patent is extended or adjusted under 35 U.S.C. 154(b) by 0 days.

(21) Appl. No.: 18/799,840

(22) Filed: Aug. 9, 2024

(65) Prior Publication Data

US 2026/0042473 A1 Feb. 12, 2026

(51) Int. Cl.
*B61L 27/16* (2022.01)

(52) U.S. Cl.
CPC ..... *B61L 27/16* (2022.01); *B61L 2201/02* (2013.01)

(58) Field of Classification Search
CPC ..... B61L 27/16; B61L 2201/02
See application file for complete search history.

(56) References Cited

U.S. PATENT DOCUMENTS

| | | | | |
|---|---|---|---|---|
| 9,711,046 | B2 * | 7/2017 | Shubs, Jr. | B61L 25/048 |
| 2009/0173839 | A1 * | 7/2009 | Groeneweg | B61L 27/53 246/15 |
| 2019/0319835 | A1 * | 10/2019 | Mansfield | B61L 15/0027 |
| 2024/0223895 | A1 * | 7/2024 | Haas | H04N 7/188 |
| 2025/0171061 | A1 * | 5/2025 | Vaughan | B61L 25/02 |
| 2025/0171062 | A1 * | 5/2025 | Vaughan | B61L 15/0081 |

* cited by examiner

*Primary Examiner* — Long T Tran
(74) *Attorney, Agent, or Firm* — McDonnell Boehnen Hulbert & Berghoff LLP

(57) ABSTRACT

Techniques and systems for planning and controlling self-propelled railway vehicles along energy-efficient routes are disclosed. A computing system may receive input parameters for at least one railway vehicle that indicate a current location of the railway vehicle, a target destination, and one or more physical attributes corresponding to the railway vehicle. The system may determine, based on the input parameters and railway map data, a route for the railway vehicle to navigate and a control strategy for the railway vehicle to use during navigation of the route. The control strategy associates a speed range with one or more portions of the route. The computing system may then provide the control strategy and the route to a control system of the railway vehicle. The control system is configured to control the at railway vehicle according to the control strategy during navigation of the route.

18 Claims, 7 Drawing Sheets

METHODS AND SYSTEMS FOR ENERGY EFFICIENT ROUTE PLANNING AND CONTROL STRATEGIES FOR SELF-PROPELLED RAILWAY VEHICLES

FIELD

The present disclosure relates to railway transportation systems, and more particularly to energy-efficient control and route planning techniques for railway vehicles that integrate modern control theory and fuzzy logic optimized by a genetic algorithm.

BACKGROUND

Freight trains and other types of railway vehicles are a common mode of transportation for a wide range of goods and materials. In general, railway vehicles are typically designed to carry heavy loads over long distances, making them a cost-effective and efficient solution for various industries. The operation of railway vehicles, particularly freight trains, typically involves a complex interplay of various factors. These factors include the physical characteristics of the individual railway vehicles and the train, such as the train's total weight and the number of railcars, as well as the conditions of the environment in which it operates, such as the grade, weather (snow or rain), temperatures, and curvature of the track. The speed at which the train travels can have a substantial impact on its energy efficiency and safety. Therefore, determining the optimum speeds for a train to travel under different conditions is a task of considerable complexity.

SUMMARY

Example embodiments relate to energy-efficient control and route planning techniques for railway vehicles, including self-propelled railcars. Such techniques may integrate modern control theory and fuzzy logic to plan energy efficient routes and determine optimal control strategies for railway vehicles. In some cases, a system may use a genetic algorithm to optimize the fuzzy logic used for route planning and determining control strategies for railway vehicles.

Accordingly, a first example embodiment describes a method. The method involves receiving, at a computing system, a plurality of input parameters for at least one railway vehicle. The plurality of input parameters indicates a current location of the at least one railway vehicle, a target destination for the at least one railway vehicle, and one or more physical attribute corresponding to the at least one railway vehicle. The method further involves determining, based on the plurality of input parameters and railway map data, a route for the at least one railway vehicle to navigate and a control strategy for the at least one railway vehicle to use during navigation of the route. The control strategy associates a speed range with one or more portions of the route for the at least one railway vehicle to use during navigation of the route. The method also involves providing, by the computing system, the control strategy and the route to a control system of the at least one railway vehicle. The control system is configured to control the at least one railway vehicle according to the control strategy during navigation of the route.

Another example embodiment describes a system. The system comprises a memory configured to store railway map data and a computing system. The computing system is configured to receive a plurality of input parameters for at least one railway vehicle. The plurality of input parameters indicates a current location of the at least one railway vehicle, a target destination for the at least one railway vehicle, and one or more physical attribute corresponding to the at least one railway vehicle. The computing system is further configured to determine, based on the plurality of input parameters and railway map data, a route for the at least one railway vehicle to navigate and a control strategy for the at least one railway vehicle to use during navigation of the route. The control strategy associates a speed range with one or more portions of the route for the at least one railway vehicle to use during navigation of the route. The computing system is also configured to provide the control strategy and the route to a control system of the at least one railway vehicle. The control system is configured to control the at least one railway vehicle according to the control strategy during navigation of the route.

An additional example embodiment describes a non-transitory computer readable medium configured to store instructions, that when executed by a computing system comprising one or more processors, causes the computing system to perform operations. The operations involve receiving a plurality of input parameters for at least one railway vehicle. The plurality of input parameters indicates a current location of the at least one railway vehicle, a target destination for the at least one railway vehicle, and one or more physical attribute corresponding to the at least one railway vehicle. The operations also involve determining, based on the plurality of input parameters and railway map data, a route for the at least one railway vehicle to navigate and a control strategy for the at least one railway vehicle to use during navigation of the route. The control strategy associates a speed range with one or more portions of the route for the at least one railway vehicle to use during navigation of the route. The operations further involve providing the control strategy and the route to a control system of the at least one railway vehicle. The control system is configured to control the at least one railway vehicle according to the control strategy during navigation of the route.

According to other aspects of the present disclosure, the control system may include potential variations. These variations could include different types of control theory, optimization algorithms, and integration with other systems, energy sources, safety features, and user interfaces.

DETAILED DESCRIPTION

Figure 1:
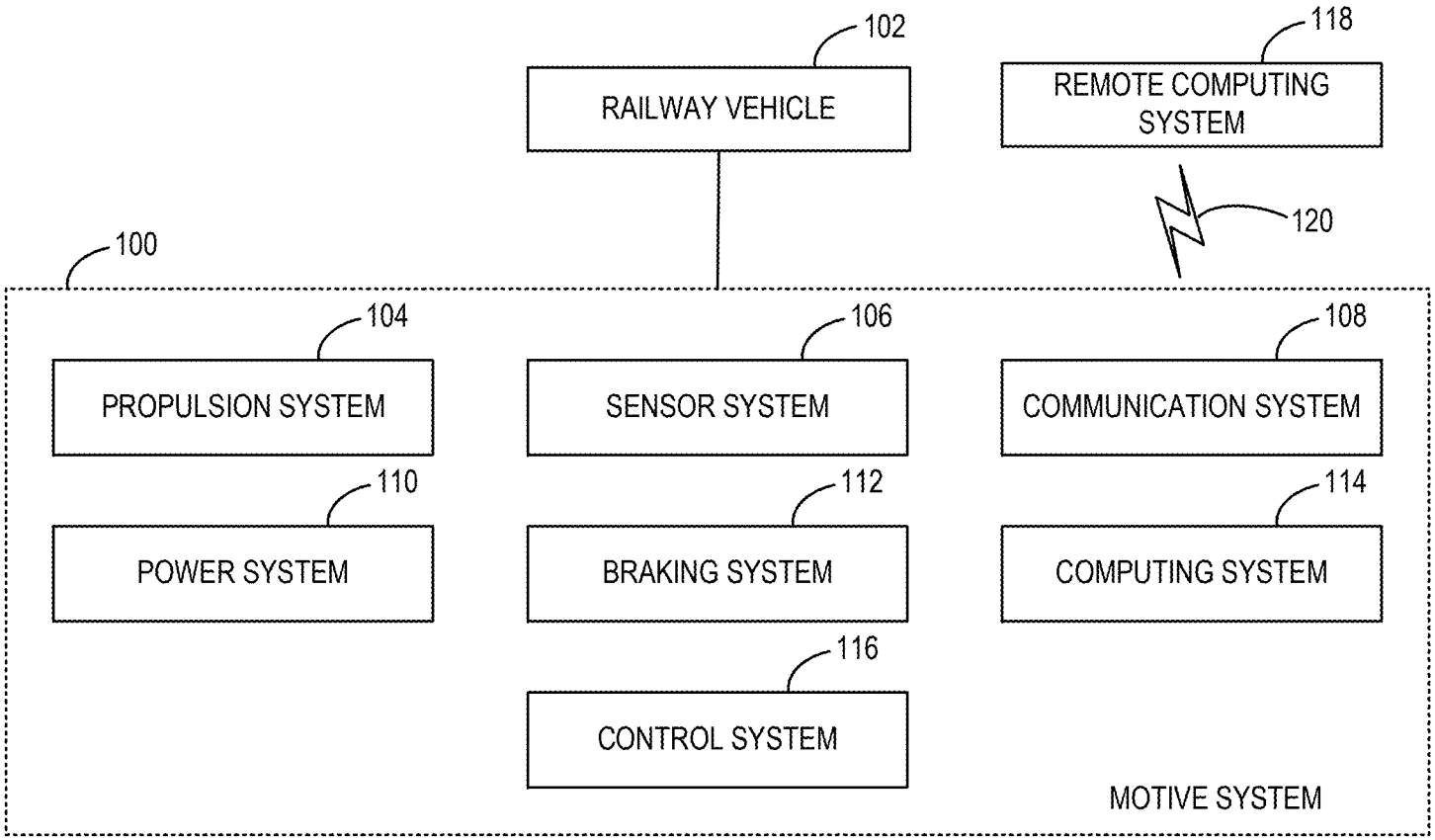
FIG. 1 is a functional block diagram illustrating a motive system for a railway vehicle, according to one or more example embodiments.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The present disclosure relates to methods and systems for implementing energy-efficient route plans and control strategies for railway vehicles, including self-propelled railway vehicles. Disclosed solutions may involve planning a route and a control strategy for a railway vehicle or train. The planned route and control strategy may be customized for the railway vehicle or train consisting of multiple railway vehicles and may involve using a combination of modern control theory and fuzzy logic to determine the optimum speeds for the railway vehicle(s) to use during different portions of the planned route. In some cases, the fuzzy logic is optimized by a genetic algorithm to further enhance the control strategy generated for the railway vehicle(s).

To develop an energy efficient route and control strategy, an example system may use various input parameters that provide valuable information for the system to factor. For instance, the input parameters used by the system may include information about the real-world environment that the railway vehicle or vehicles will likely encounter during travel of the potential routes. This information about real-world environment conditions are described herein as environment parameters. Example environment parameters may describe the different grades of areas, curvatures, tunnels, speed restrictions and speed limits, and other aspects of the environment that may have safety considerations.

In addition to the environment parameters, the system may also factor information about the railway vehicle or railway vehicles that will use the planned route and control strategy generated by the system. Described herein as railway vehicle parameters, these parameters may provide information related to performance metrics of individual railways vehicles, performance metrics of a train overall, information about the load being transported, and other related information (e.g., performance metrics for components). Example railway vehicle parameters may include motor and individual railway vehicle speed limits, size dimensions and type of railway vehicles, the masses of individual railway vehicles and the train overall, number of propelled rail cars and locomotives, quantity of railway vehicles in the train, power ratings for motors, and power limits for each railway vehicle within the train, among other potential parameters.

Other input parameters may be considered by the system as well. For instance, additional parameters may provide information related to track use, weather conditions, track signals and traffic infrastructure, and information regarding any accidents, damage to infrastructure or railway vehicles, or delays on the railway tracks, etc.

The system may integrate modern control theory, fuzzy logic, and genetic algorithms to assist with route planning and determining optimum speeds and control parameters for the railway vehicle or vehicles to use to travel efficiently and safely. In particular, the system may leverage the strengths of these different techniques to handle the complexity and uncertainty inherent in route planning and railway vehicle control. The combination of techniques may be particularly advantageous due to their complementary strengths.

In general, modern control theory provides a mathematical framework for analyzing and controlling systems, which makes modern control theory useful for modeling the complex dynamics of a train or individual railway vehicles. A planning and control system may use modern control theory to precisely model the behavior of a train (or individual railway vehicles) based on the physical characteristics of the train and the conditions of its environment, enabling the system to accurately predict the train's future states. Fuzzy logic, on the other hand, can be used to factor the inherent uncertainty in the operations of a train or an individual railway vehicle. Unlike traditional Boolean logic, which deals with absolute truths and falsehoods, fuzzy logic allows for degrees of truth. This enables the system to use fuzzy logic to handle the uncertainties and ambiguities that often arise in real-world situations, such as changes in the weather, changes in the surrounding environment and/or changes in the condition of one or more railway vehicles.

In some examples, genetic algorithms may be used to provide a powerful optimization technique that can fine-tune the performance of the system. By simulating the process of natural evolution, genetic algorithms can be used to iteratively improve the system's parameters, allowing the system to identify the optimum speeds and other operational parameters (e.g., braking distances) for the train (or individual railway vehicles) during different portions of various routes and under different conditions.

Leveraging the strengths of these different techniques can enable the system to effectively handle the complexity and uncertainty associated with route planning and determining the optimal control strategy for a train to use during travel of different portions of the planned route. As such, the system may use disclosed techniques to enhance the energy efficiency and safety of a train (or individual railway vehicles) while also improving the system's robustness and ability to adapt to changing conditions, such as changes in the environment and changes in the performance of components of the railway vehicles. For instance, the system may adjust speeds and other control parameters for one or multiple railway vehicles within a train to maintain optimal performance in response to detecting various types of changes, such as a detected change in the weight of one or more railway vehicles in the train, an obstacle positioned on the track, or a change in weather conditions. The system's adaptability can provide a major advantage in the dynamic and unpredictable world of train operation, where conditions can change rapidly and without warning.

In some cases, the system may adapt to changes in input data, such as stopping distance or weight of the train, and ensure safe travel while maintaining energy efficiency. The system may handle unexpected obstacles or changes in the route and can integrate with other systems, including external and onboard systems. For instance, the system may interface with a Global Position System (GPS) or a weather forecasting system to gather additional information that can be used during route planning and control strategy determination. In some cases, the system may factor strategic goals when determining modifications to the route and/or control strategy. For instance, the system may factor the train's target arrival time, the state of batteries used by one or multiple railway vehicles, performance metrics of motors or other components, and/or changes in weather conditions or track use, among other factors.

In some aspects, the system may use a comprehensive sensor system to detect various types of obstacles on the track and other changes in the environment that could affect the operation of the train. Similarly, the sensor system may also obtain measurements representing the state and operation metrics for motors, battery systems, and other components of the railway vehicle. As such, the sensor system may include one or multiple sensors positioned on one or more railway vehicles. For instance, the sensor system may include one or multiple inertial measurement units (IMUs), which can detect sudden movements or shifts in the train's position that may indicate an obstacle or a change in the track's condition. IMUs can provide useful data on the train's acceleration, orientation, and gravitational forces, enabling the system to factor the IMU data when adjusting the control strategy to maintain stability and safety.

Additionally, the system may use one or more cameras strategically positioned around the train to provide a visual assessment of the track and the train's immediate surroundings. Cameras can capture real-time images or video feeds that can be analyzed using computer vision algorithms to identify obstacles such as debris, fallen trees, pedestrians, damaged track, or vehicles on the track. By processing these visual inputs, the system can determine the nature of the obstacle and decide on the appropriate response, such as slowing down or stopping the train.

Lidar sensors may also be used by the system to enhance the detection capabilities. Lidar, which uses laser pulses to measure distances, can create detailed three-dimensional maps of the train's environment, even in poor visibility conditions. Lidar data can be particularly useful for detecting smaller or low-lying obstacles that might not be as easily visible to cameras. In addition, the precise distance measurements provided by lidar can help the system to calculate the stopping distance and adjust the train's speed accordingly.

Radar sensors can also be used by the system to complement the lidar and camera systems by providing additional data on the position and speed of objects relative to the train. Radar can be effective in adverse weather conditions and can detect obstacles at a greater distance, allowing for early warning and more time for the system to react. The combination of radar with lidar and cameras can provide a robust detection system that ensures the train has a comprehensive understanding of its environment. Some examples may involve using one or a combination of these sensors to gather information about the environment surrounding a railway vehicle or an entire train as the railway vehicle(s) travel a route.

In some cases, the system may integrate data from various types of sensors to create a more accurate and reliable picture of the train's surroundings. For example, combining IMU data with camera and lidar inputs can help the system to differentiate between a stationary obstacle and one that is moving, such as an animal crossing the tracks. By fusing data from multiple sensors, the system can improve its decision-making process and control strategy, ensuring that the train operates safely and efficiently in the presence of obstacles or other environmental changes.

In some examples, the system may be designed for battery-operated railway vehicles with the goal of maintaining the battery charge over time. A battery-operated railway vehicle may be any type of railway vehicle that is powered by one or more rechargeable battery systems. In some cases, the battery-operated railway vehicle is an existing freight railcar that was retrofitted with a battery system and other components (e.g., electric motor). A battery-operated railway vehicle may use one or multiple electric motors for propulsion, which draw power from the onboard battery systems. The battery systems can be charged through external power sources or through regenerative braking systems. The system may manage the energy usage and regeneration in a way that the state of charge of the battery remains relatively constant over time by balancing the energy drawn from the battery for propulsion and other operations with the energy regenerated through mechanisms like regenerative braking.

The system may alert the train operator of potential problems through the Vehicle Management System (VMS). In some examples, the VMS is a real-time software and hardware system integrated into the train that monitors, controls, and manages various aspects of the train's operation in real-time. The VMS includes monitoring the status of the train's engine, brakes, battery system, and other components, and alerting the train operator or a remote control system of any potential problems or malfunctions.

In some examples, the system may be designed to operate passively, performing operations without requiring interaction or instructions from a user. When operating passively, the system may function autonomously without requiring active input or interaction from an operator or user, instead using sensor data, algorithms, and pre-set rules to make decisions and control the operations of the train, including speed control, energy management, and safety features. A train operator may refer to an individual or automated system responsible for controlling and managing the operation of the train. In the context of the example system, the train operator may be alerted of potential problems or malfunctions by the VMS, but does not actively control the operation of the train.

Some examples may use different types of control theory, optimization algorithms, and integration with other systems, energy sources, safety features, and user interfaces. The variations may provide additional flexibility and adaptability, allowing the system to be tailored to specific operational requirements or environmental conditions.

In some aspects, the energy-efficient control system may offer several advantages over traditional train control systems. These advantages may include improved energy efficiency, safety, user-friendliness, and integration with other systems. The system's ability to adapt to real-time changes in the environment and the conditions of the train (or individual railway vehicles) can lead to more efficient and safer trajectories, while the system's passive operation can reduce the workload for the operator and the risk of human error. Furthermore, the system's design for battery-operated vehicles can help maintain the battery charge over time, reducing the frequency of charging and extending the operational range of the vehicles.

Systems and techniques presented herein can be used for optimizing operations of various types of vehicles, including non-railway vehicles. For instance, systems can optimize operations for trucks, cars, robotic devices, aircraft, drones, construction equipment, farm equipment, trolleys, and other types of vehicles.

The following description and accompanying drawings will elucidate features of various example embodiments. The embodiments provided are by way of example, and are not intended to be limiting. As such, the dimensions of the drawings are not necessarily to scale. Example systems and methods within the scope of the present disclosure will now be described in greater detail.

Referring now to the figures, FIG. 1 is a functional block diagram showing motive system 100, which can be implemented on railway vehicle 102 and configured to perform disclosed operations. In the example embodiment, motive system 100 may include various subsystems, such as propulsion system 104, sensor system 106, communication system 108, power system 110, braking system 112, computing system 114, and control system 116. In other examples, motive system 100 may include more or fewer subsystems. In addition, the subsystems and other components of motive system 100 can be interconnected via wired or wireless connections and operations performed by motive system 100 can be divided into additional functional or physical components and/or combined into fewer functional or physical components within examples.

Railway vehicle 102 represents any type of vehicle that can transport people and/or cargo on a railway track. This includes, but is not limited to, freight trains, passenger trains, locomotives, trolleys, and other types of railcars. Railway vehicles are typically designed to transport goods, materials, or passengers over long distances and may be capable of self-propelling functions. For instance, railway vehicle 102 may be powered by various types of energy sources, such as diesel, electricity (e.g., battery system), or alternative fuels. In some cases, railway vehicle 102 is a self-propelled railcar equipped with the disclosed energy-efficient control system.

In some examples, railway vehicle 102 may be a freight car or a flatbed car configured to move materials or other types of materials. For instance, railway vehicle 102 may be a burdened rail vehicle. Traditional locomotives are unburdened (i.e., not carrying payload) whereas traditional freight railcars are unpowered and serve to carry payloads similar to trailers as burdened vehicles. As such, the size, shape, and configuration of railway vehicle 102 can differ within examples. In addition, the number and types of axles and wheels on railway vehicle 102 can vary. Generally, railway vehicle 102 may include two axles per truck with two trucks per railcar. Railway vehicle 102 may include one or multiple types of couplers that enable railway vehicle 102 to be coupled to other railway vehicles.

Propulsion system 104 of motive system 100 may be designed with a variety of components to provide powered motion for the railway vehicle 102. For instance, propulsion system 104 could include one or more motors that utilize power from power system 110 to generate torque, thereby rotating the wheels of railway vehicle 102.

In some cases, propulsion system 104 may be designed with different types of motors. For example, propulsion system 104 could use electric motors, hydraulic motors, or pneumatic motors. These different types of motors could provide different benefits, such as improved energy efficiency or increased torque. In addition, propulsion system 104 could use power from different types of power systems. For instance, propulsion system 104 may use power from a battery (or battery system), a fuel cell, a solar panel, or a generator. These different types of power systems could provide different benefits, such as improved energy efficiency or increased operational range.

In addition, propulsion system 104 may generate torque in different ways. For example, propulsion system 104 may use a gearbox to increase the torque or a direct drive system to eliminate the gearbox and reduce mechanical losses. These different methods of torque generation could provide different benefits, such as improved efficiency or reduced maintenance requirements. Similarly, propulsion system 104 may also rotate the wheels of the railway vehicle 102 in different ways. For example, propulsion system 104 may use a chain drive, a belt drive, or a direct drive system. These different methods of wheel rotation could provide various benefits, such as improved efficiency or reduced noise.

Furthermore, propulsion system 104 could be configured in different ways. For example, propulsion system 104 may be a centralized system with a single motor driving all the wheels, or it could be a distributed system with individual motors driving each wheel. The different configurations could be selected based on the different benefits that each configuration is designed to provide, such as improved traction or increased redundancy.

Sensor system 106 may include one or multiple sensors that can help enhance the performance of the railway vehicle 102. In particular, sensor system 106 may be used to gather and process data about the environment in which railway vehicle 102 operates, the performance of the vehicle's components, and to tailor the performance of the railway vehicle 102 to suit its environment. In some examples, sensor system 106 may encompass a diverse range of sensors, such as one or more radars, lidars, cameras, wind sensors, force sensors, contact sensors, precipitation sensors, light sensors, humidity sensors, strain gauges, thermal imaging sensors, radio navigation units, encoders, resolvers, laser range finding sensors, Radio-Frequency Identification (RFID) sensors, gyroscopes and magnetometers, accelerometers, magnetic sensors, microphones, strain and weight sensors, Global Positioning Systems (GPS), inertial measurement units (IMUs), passive infrared sensors, ultrasonic sensors, wheel speed sensors, and/or throttle/brake sensors. Railway vehicle 102 may include one or more of these sensors as well as other types of sensors. As such, a wide array of sensors may allow system 100 to gather a comprehensive set of data about a train's operation and its environment, enhancing the control system's ability to determine the optimum speeds for the train.

Sensor system 106 may also include sensors that are specifically configured to monitor the existing components of railway vehicle 102. This could include sensors that monitor the status and performance metrics of the train's engine, brakes, battery system, and other components. In some cases, sensor system 106 may also use multiple sensors to provide safety redundancy, ensuring that motive system 100 can continue to operate safely even if one sensor fails. This redundancy feature enhances the reliability and safety of the control system of railway vehicle 102, ensuring that it can maintain optimum operation even in the event of sensor failures.

The sensors from sensor system 106 can be strategically placed on different components of railway vehicle 102. For instance, some sensors could be positioned on the couplers of railway vehicle 102, while others may be housed in a specific container positioned near the front or rear end of railway vehicle 102. Some sensors could be designed to measure specific aspects of the couplers on railway vehicle 102. For instance, these sensors could provide data on the stress level on the couplers, which could be used to monitor the structural integrity of the couplers and prevent potential failures. In some examples, sensors are positioned on the wheels or axles to monitor their rotation and detect any irregularities. Sensors may also be placed inside the cargo compartments to monitor the condition of the cargo, such as temperature or humidity sensors for perishable goods. A strategic placement of sensors allows sensor system 106 to gather detailed and accurate data about the train's operation and its components, enhancing the control system's ability to determine an optimal control strategy for railway vehicle 102.

In some examples, sensor system 106 may include sensors that can detect waypoints positioned along the railway track. The waypoints may provide useful information about the location, direction, and speed of railway vehicle 102, which could be used by the control system to adjust the operations of railway vehicle 102 in real-time. Sensor system 106 may also enable railway vehicle 102 to triangulate its position relative to off-board radio stations and other sources of communication signals, such as 4G or 5G towers. This could provide more accurate and real-time data about the location and speed of railway vehicle 102, enhancing the control system's ability to determine the optimum speeds for railway vehicle 102 as conditions change.

Sensor system 106 can also be used to weigh railway vehicle 102 and adjust the performance of the electric motors and other components located on railway vehicle 102. This could involve sensors that measure the weight of railway vehicle 102 and its cargo, which could be used to adjust speed of railway vehicle 102 and power output to maintain optimum energy efficiency and safety. This weight measurement feature can allow the control system to adapt the operation of railway vehicle 102 to its load, ensuring that motive system 100 can maintain optimum energy efficiency and safety even as the weight of railway vehicle 102 shifts or changes.

In some examples, sensor system 106 can be supplemented by additional devices. These devices could include additional sensors, control systems, or communication devices that enhance the performance and functionality of sensor system 106. This flexibility in the design of sensor system 106 allows it to adapt to different operational requirements and environmental conditions, enhancing its performance and functionality.

In some examples, sensor system 106 may include a motor encoder and/or resolver data, which can be used to detect wheel slipping on railway vehicle 102 due to wet, icy, or debris-laden tracks. In response to this detection, computing system 114 may implement effective control strategies to maintain the traction and safety of railway vehicle 102. Onboard sensors can also be used to detect potential vandalism. For instance, computing system 114 may use cameras and radar to detect potential vandalism and responsively transmit information to a user and/or authorities to protect the cargo and payloads via communication system 108.

In addition, sensor system 106 can be used for automated track inspections and to determine the condition of the rail. In some cases, computing system 114 may determine deviation from normal rail characteristics based on sensor data from sensor system 106. For instance, computing system 114 may detect railcar hunting, vibration, and other dynamics based on sensor data obtained from sensor system 106. This could provide valuable information about the condition of the track and the train's operation, which may be used by computing system 114 to adjust the train's speed and trajectory to maintain optimum energy efficiency and safety.

In some examples, sensor system 106 may also include different types of sensors beyond those mentioned. For instance, sensor system 106 may include pressure sensors to monitor the air pressure in the pneumatic braking system, vibration sensors to detect abnormal vibrations in the components of railway vehicle 102, or acoustic sensors to detect unusual noises that could indicate a mechanical problem. These additional sensors could provide more comprehensive data about the operations of railway vehicle 102 and its environment, further enhancing the control system's ability to determine the optimal speeds for railway vehicle 102.

Sensor system 106 may be integrated with other systems on a train. For example, sensor system 106 may be integrated with communication system 108 to transmit sensor data to a remote control station (e.g., remote computing system 118) or to other trains. Sensor system 106 could also be integrated with power system 110 to draw power for its operation. This integration could enhance the functionality and efficiency of sensor system 106, allowing more effective and reliable operation.

The sensor data may be processed in different ways to determine control strategy for railway vehicle 102. For example, the data may be processed using machine learning algorithms to learn from past data and make more accurate predictions about speed ranges to use during navigation along certain portions of track. The speed ranges may depend on weather conditions, type and size of load, and/or other parameters (e.g., length of train). Sensor data may also be processed using statistical methods to analyze the data and identify patterns or trends that could be used to optimize the speed and other control parameters of railway vehicle 102.

In some examples, sensor system 106 may include additional layers of redundancy to ensure its reliability and safety. For example, sensor system 106 may include multiple sensors of the same type, so that if one sensor fails, the others can continue to provide data. Sensor system 106 could also include backup power sources for the sensors, ensuring that they can continue to operate even if the main power source fails. In addition, the sensors within sensor system 106 may be calibrated in different ways to ensure their accuracy and reliability. For example, sensors may be calibrated using standard calibration techniques, or they could be self-calibrating, adjusting their calibration based on the data they collect. This could enhance the accuracy and reliability of the sensor data, further improving the control system's ability to determine the optimum speeds for the train.

As further shown in FIG. 1, motive system 100 may include communication system 108, which may be used to communicate with one or more devices (e.g., remote computing system 118) directly or via a communication network (e.g., wireless connection 120). In some examples, communication system 108 may include one or multiple dedicated short-range communications (DSRC) devices that could include public and/or private data communications with stations positioned near tracks.

In general, communication system 108 may facilitate the exchange of information with other devices and between components of railway vehicle 102. The exchange of information could include communication with remote computing system 118, which might be a centralized server or control station that oversees the operation of multiple trains. The communication between the control system of railway vehicle 102 and remote computing system 118 may be facilitated through a communication network, such as a wireless connection 120. This may involve using standard wireless communication protocols, such as Wi-Fi or cellular networks, or it could involve using specialized communication protocols designed for railway operations.

In some embodiments, communication system 108 may include one or more dedicated short-range communications (DSRC) devices. These devices are designed to provide reliable, high-speed wireless communication over short distances, making them ideal for communication with stations positioned near the tracks. The DSRC devices could support both public and private data communications, allowing them to exchange information with a wide range of devices and systems. For example, DSRC devices may be used to communicate with sensors or control systems located at railway stations, crossings, or other points of interest along the tracks.

In addition to DSRC devices, communication system 108 may also include other types of communication devices or technologies. For instance, communication system 108 may include long-range communication devices for communicating with remote control stations or other trains over longer distances. Communication system 108 may also include satellite communication devices for global positioning or communication with satellite-based systems. Furthermore, communication system 108 may also include wired communication devices (e.g., Ethernet, cables) for connecting with onboard systems or devices, such as control system 116, computing system 114, and sensor system 106.

Communication system 108 may also be designed to support different types of data communications. For example, communication system 108 may support real-time data communication for immediate control or monitoring purposes. Communication system 108 may also support batch data communication for transmitting larger amounts of data at scheduled intervals. Moreover, communication system 108 may support secure data communication for transmitting sensitive or confidential information, such as operational data or safety information.

Power system 110 represents one or multiple power sources that can supply power to different components of motive system 100 and/or railway vehicle 102. In some cases, power system 110 may be shared across multiple railway vehicles within a train set. For instance, direct electrical connections can exist between power systems on different railway vehicles within a train. In addition, multiple power systems may be used to share energy in optimal ways, such as using an overcharged battery pack to kinetically recharge a depleted or lower state of charge battery pack. Batteries can be recharged during operation of railway vehicle 102, such as through regenerative braking, or they can be replaced or recharged during stops. In addition to batteries, power system 110 may also use petroleum-based fuels or gas-based fuels. These energy sources can provide a high amount of energy, making them suitable for long-distance travel or heavy-duty operations. Alternatively, the power system 110 could use solar panels or other types of renewable energy sources. These sources can provide a sustainable and environmentally-friendly source of power, although their output can be variable and dependent on environmental conditions.

In some embodiments, the power system 110 may include a combination of different power sources. For example, it could include a combination of batteries, capacitors, and/or flywheels. This hybrid approach can provide the benefits of multiple power sources, such as the high energy density of batteries, the rapid charge and discharge capabilities of capacitors, and the mechanical energy storage of flywheels.

Braking system 112 may represent one or multiple supplementary brake systems that motive system 100 may include to further enhance performance of railway vehicle 102. The primary braking system can be pneumatic, with brake airlines pressurized from compressors on board the locomotive, and used in conjunction with braking system 112. For instance, braking system 112 may be a regenerative brake system that can serve as an energy recovery mechanism that also slows down the railway vehicle by converting its kinetic energy into a form that can be used immediately or stored until needed. For instance, braking system 112 may convert kinetic energy into energy stored by one or more batteries of power system 110. In some instances, braking system 112 can dissipate the energy as heat, such as when the battery storage on railway vehicle 102 is full. This heat dissipation can help prevent overheating of the batteries and prolong their lifespan.

In some embodiments, braking system 112 can be a regenerative braking system that can be used to feed electricity directly into the electrical grid through overhead catenary lines or other technologies (e.g., third rails used for power). Braking system 112 may also be used during short sections of track without requiring full electrification of the track lines to take advantage of traditional un-electrified rail as well as short electrified sections for recharging and returning power to the grid.

Computing system 114 represents one or multiple computing devices that can perform operations, such as the various operations described herein. Computing system 114 may include one or multiple processors that can execute instructions stored in a non-transitory computer readable medium (e.g., data storage). The instructions can enable computing system 114 to operate with the various subsystems of motive system 100 and other computing devices (e.g., remote computing system 118).

In some examples, motive system 100 may use communication system 108 to facilitate the exchange of data and control signals with remote computing system 118. This communication could be facilitated over wireless connection 120, which could involve standard wireless communication protocols, such as Wi-Fi or cellular networks, or it could involve specialized communication protocols designed for railway operations.

In addition to its computational and communication capabilities, computing system 114 may also include one or multiple user interface elements. These elements enable users to interact with the system, providing instructions and receiving information from the motive system 100. For instance, computing system 114 may include one or more input/output devices, such as a tablet touchscreen for intuitive control and data input, a speaker for auditory feedback or alerts, and a microphone for voice commands or communication.

In some embodiments, computing system 114 is designed with a focus on reliability and resilience. For instance, computing system 114 may be designed to be self-redundant, offering duplex or triplex redundancy in case of a partial system failure. This design allows computing system 114 to continue operations safely in the event of a failure, ensuring that railway vehicle 102 can maintain its mission, operation, and safety. Furthermore, the redundant system can also serve as a verification and validation mechanism for the sensor inputs received from sensor system 106. This can enhance the accuracy and reliability of the data used by the system, further improving its performance and safety.

Control system 116 can include one or multiple components designed to assist in the operations of railway vehicle 102. For instance, control system 116 can include components that enable control of other components of motive system 100 and/or a proportional-integral-derivative controller (PID controller or three-term controller) that is a control loop mechanism employing feedback that is widely used in industrial control systems and a variety of other applications requiring continuously modulated control. In some examples, remote computing system 118 may communicate control instructions to control system 116, which can then execute a control strategy based on the control instructions.

Remote computing system 118 represents a computing system that may provide information and/or control instructions to motive system 100 and/or railway vehicle 102. For instance, remote computing system 118 may be a smartphone, server, laptop, tablet, wearable computing device, and/or another type of device that enables inputs to different components within motive system 100. Remote computing system 118 may provide a user interface that enables remote control of railway vehicle 102.

Motive system 100 may include other pneumatic elements for auxiliary services, such as dump, gate, hatch, or door actuation. These systems can be actuated via solenoids remotely or manually. Gate, hatch, or door actuation can be supplied from the same compressors or completely separate air systems from the brake air infrastructure. In addition, motive system 100 can also include additional systems, such as a cooling system that can service the needs of other systems. For instance, the cooling system can cool onboard battery storage, electric motors, inverters using liquid or air cooled subsystems in order to keep the components in satisfactory operating temperatures. The cooling system can also be used to cool the compressors and air drying/treating equipment for the pneumatic systems. This can help to maintain the efficiency and reliability of these systems, as well as prolong their lifespan. The cooling systems could be interconnected in various ways to optimize their performance and efficiency. For example, they could be linked in a single loop, allowing the coolant to flow through all the systems in a continuous cycle. Alternatively, they could be arranged in series or parallel configurations, depending on the thermal loads and cooling requirements of the different systems. In some cases, each system may have its own dedicated subsystem for cooling. This can provide more precise control over the cooling of each system and can be beneficial in situations where the systems have different cooling requirements or operating conditions.

In other cases, a combination of a master cooling system and additional cooling subsystems can be used. The master cooling system could provide the primary cooling for the major components of motive system 100, while the additional cooling subsystems could provide supplementary cooling for specific components or systems. This hybrid approach can provide a balance between efficiency and flexibility, allowing the cooling system to adapt to a wide range of operational scenarios and environmental conditions.

Figure 2:
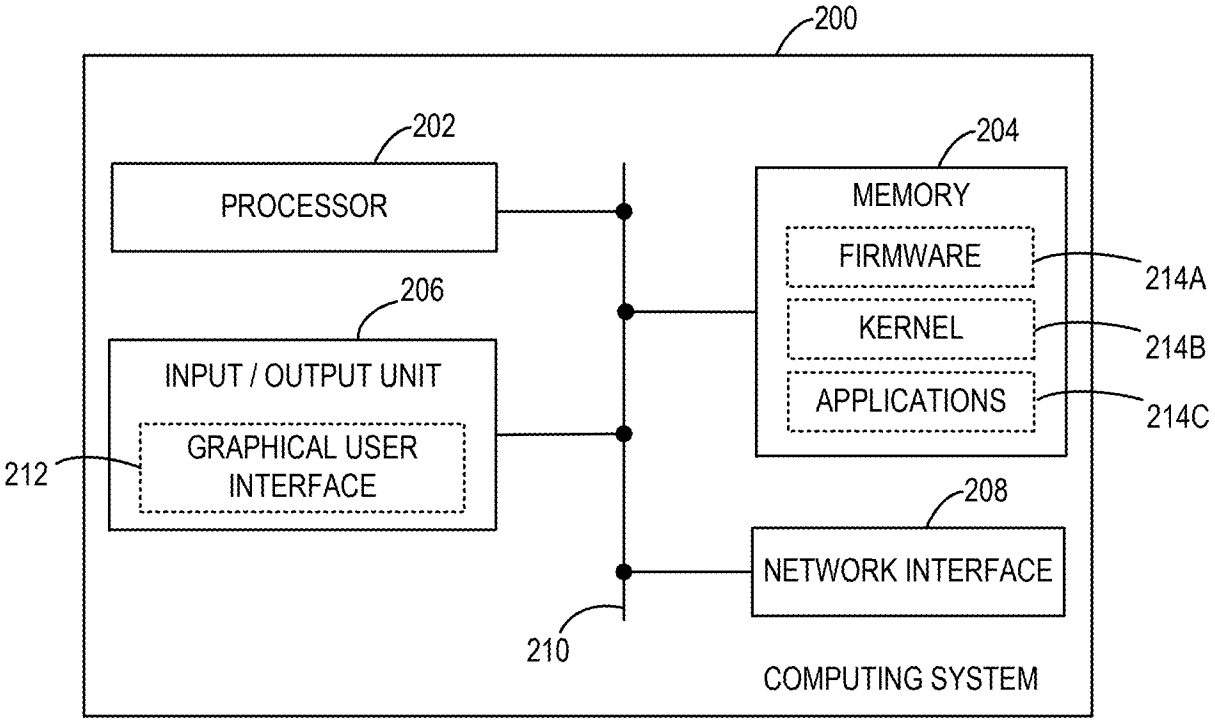
FIG. 2 is a functional block diagram illustrating a computing system, according to one or more example embodiments.

FIG. 2 is a block diagram of computing system 200, illustrating some of the components that could be included in a computing device arranged to operate in accordance with the embodiments herein. As such, computing system 200 may be implemented as computing system 114 of motive system 100 and/or remote computing system 118 shown in FIG. 1. In some examples, computing system 200 may communicate with one or more accessories attached to a railway vehicle via one or more bearing adapters.

In the example embodiment shown in FIG. 2, computing system 200 includes processor 202, memory 204, input/output unit 206, and network interface 208, all of which may be connected by a system bus 210 or a similar mechanism. In some example embodiments, computing system 200 may include other components and/or peripheral devices (e.g., detachable storage and/or sensors).

Processor 202 may be one or more of any type of computer processing element, such as a central processing unit (CPU), a co-processor (e.g., a graphics processor), a digital signal processor (DSP), a network processor, and/or a form of integrated circuit (e.g., a field programmable gate array (FPGA)) or controller that performs processor operations. As such, processor 202 may be one or more single-core processors and/or one or more multi-core processors with multiple independent processing units. In addition, processor 202 may also include register memory for temporarily storing instructions being executed and related data, as well as cache memory for temporarily storing recently-used instructions and data.

Memory 204 may be any form of computer-usable memory, including but not limited to random access memory (RAM), read-only memory (ROM), and non-volatile memory. This may include flash memory, hard disk drives, solid state drives, rewritable compact discs (CDs), rewritable digital video discs (DVDs), and/or tape storage, as just a few examples. Computing system 200 may include fixed memory as well as one or more removable memory units, the latter including but not limited to various types of secure digital (SD) cards. As an example result, memory 204 can represent both main memory units as well as long-term storage.

Memory 204 may store program instructions and/or data on which program instructions may operate. By way of example, memory 204 may store these program instructions on a non-transitory, computer-readable medium, such that the instructions are executable by processor 202 to perform any of the methods, processes, or operations disclosed in this specification or the accompanying drawings.

As shown in FIG. 2, memory 204 may include firmware 214A, kernel 214B, and/or applications 214C. Firmware 214A may be program code used to boot or otherwise initiate some or all of computing system 200. Kernel 214B may be an operating system, including modules for memory management, scheduling and management of processes, input/output, and communication. In addition, kernel 214B may also include device drivers that allow the operating system to communicate with the hardware modules (e.g., memory units, networking interfaces, ports, and busses) of computing system 200. Applications 214C may be one or more user-space software programs, such as web browsers or email clients, as well as any software libraries used by these programs. In some examples, applications 214C may include one or more control systems 116, neural network applications and other deep learning-based applications. Memory 204 may also store data used by these and other programs and applications.

Input/output unit 206 may facilitate user and peripheral device interaction with computing system 200, sensors, and/or other computing systems, such as computing systems on other railway vehicles and/or positioned remote from a train. Input/output unit 206 may include one or more types of input devices, such as a keyboard, a mouse, one or more touch screens, sensors, biometric sensors, and so on. Similarly, input/output unit 206 may include one or more types of output devices, such as a screen, monitor, printer, speakers, and/or one or more light emitting diodes (LEDs). Additionally or alternatively, computing system 200 may communicate with other devices using a universal serial bus (USB) or high-definition multimedia interface (HDMI) port interface, for example. In some examples, input/output unit 206 can be configured to receive data from other devices. For instance, input/output unit 206 may receive sensor data from sensors, such as sensors positioned on a railway vehicle. As shown in FIG. 2, input/output unit 206 includes Graphical User Interface (GUI) 212, which can be configured to provide information to a user. GUI 212 may involve one or more display interfaces, or another type of mechanism for conveying information and receiving inputs. Some common rail techniques can involve signal lighting, horns, and bells, which can be implemented via input/output unit 206. With many techniques in traditional rail being visual and auditory in nature, these techniques in addition to more advanced signaling and human machine interfaces can be implemented.

Network interface 208 may take the form of one or more wireline interfaces (e.g., Ethernet) and/or enable communication over one or more wireless interfaces, such as IEEE 802.11 (Wi-Fi), BLUETOOTH®, global positioning system (GPS), 3G, 4G, 5G, or a wide-area wireless interface. In addition, other forms of physical layer interfaces and other types of standard or proprietary communication protocols may be used over network interface 208.

Figure 3:
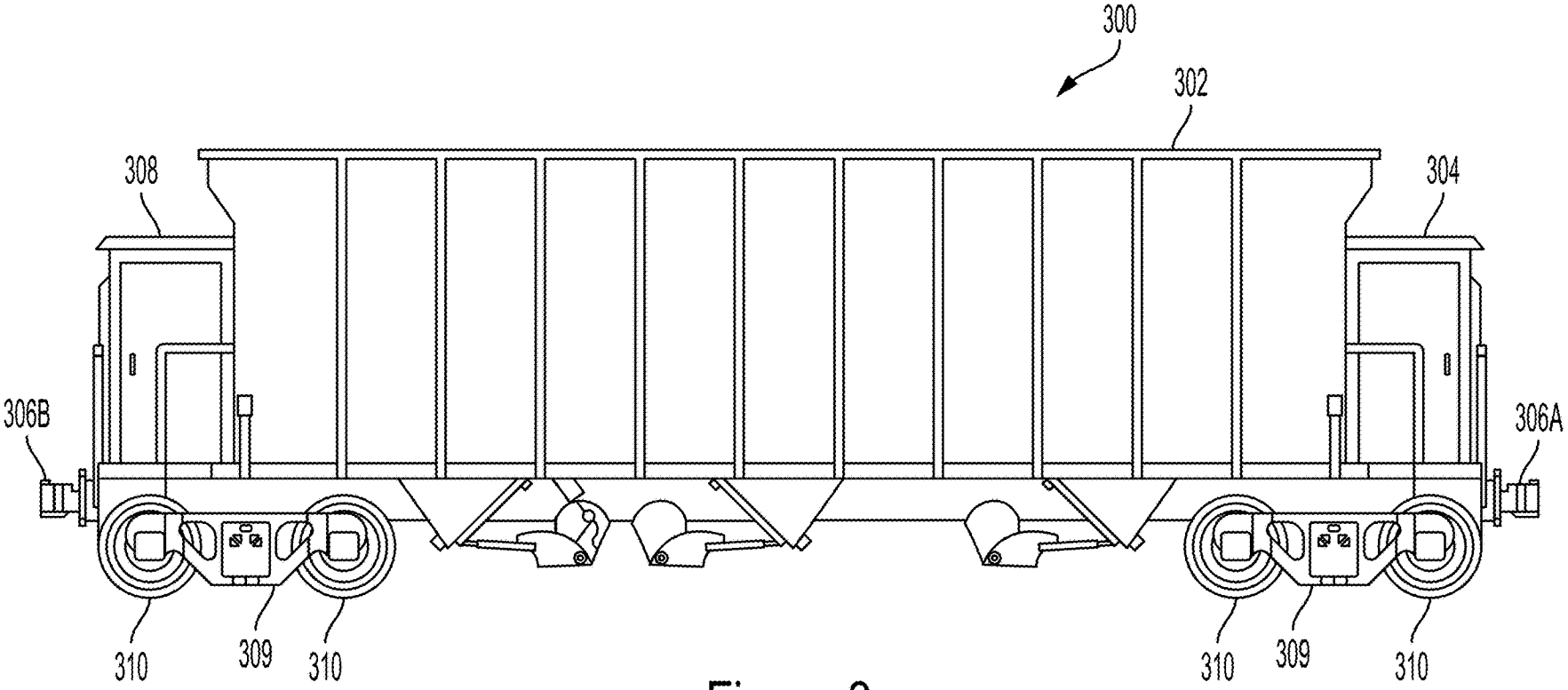
FIG. 3 is a configuration of a railway vehicle with a motive system, according to one or more example embodiments.

FIG. 3 illustrates a configuration of railway vehicle 302 equipped with motive system 300. In the example embodiment, motive system 300 is implemented on railway vehicle 302 and includes sensor system 304 positioned near front coupler 306A and battery storage 308 located near rear coupler 306B. Railway vehicle 302 may be controlled according to a route and a control strategy determined by a computing system performing techniques presented herein.

In the example embodiment, railway vehicle 302 is shown as a freight vehicle designed to carry materials and other cargo between locations. Railway vehicle 302 has front side 312 and rear side 314, which can each be attached to different railway vehicles within a trainset via front coupler 306A and rear coupler 306, respectively. As shown, railway vehicle 302 includes bogies 309 (or trucks) that enable movement on wheels 310. As such, motive system 300 can involve installation of one or multiple components (e.g., electric motors, braking systems) on bogies 309 via one or more bearing adapters and other components of railway vehicle 302. Railway vehicle 302 can have alternative configurations within other embodiments. In addition, railway vehicle 302 can be part of a train that includes one or multiple railway vehicles equipped with motive systems 300.

Motive system 300 can be implemented as motive system 100 shown in FIG. 1 and can include one or more electric drive systems and an auxiliary braking system that can enable motive system 300 to perform operations disclosed herein that can enhance overall performance of railway vehicle 302. For instance, motive system 300 may include one or multiple electric drivetrains that can be used to turn axles connected to wheels 310. In addition, motive system 300 may also include a regenerative braking system that can be used to convert energy from one or more axles and/or wheels 310 and deliver energy to battery storage 308 during braking applications.

Figure 4:
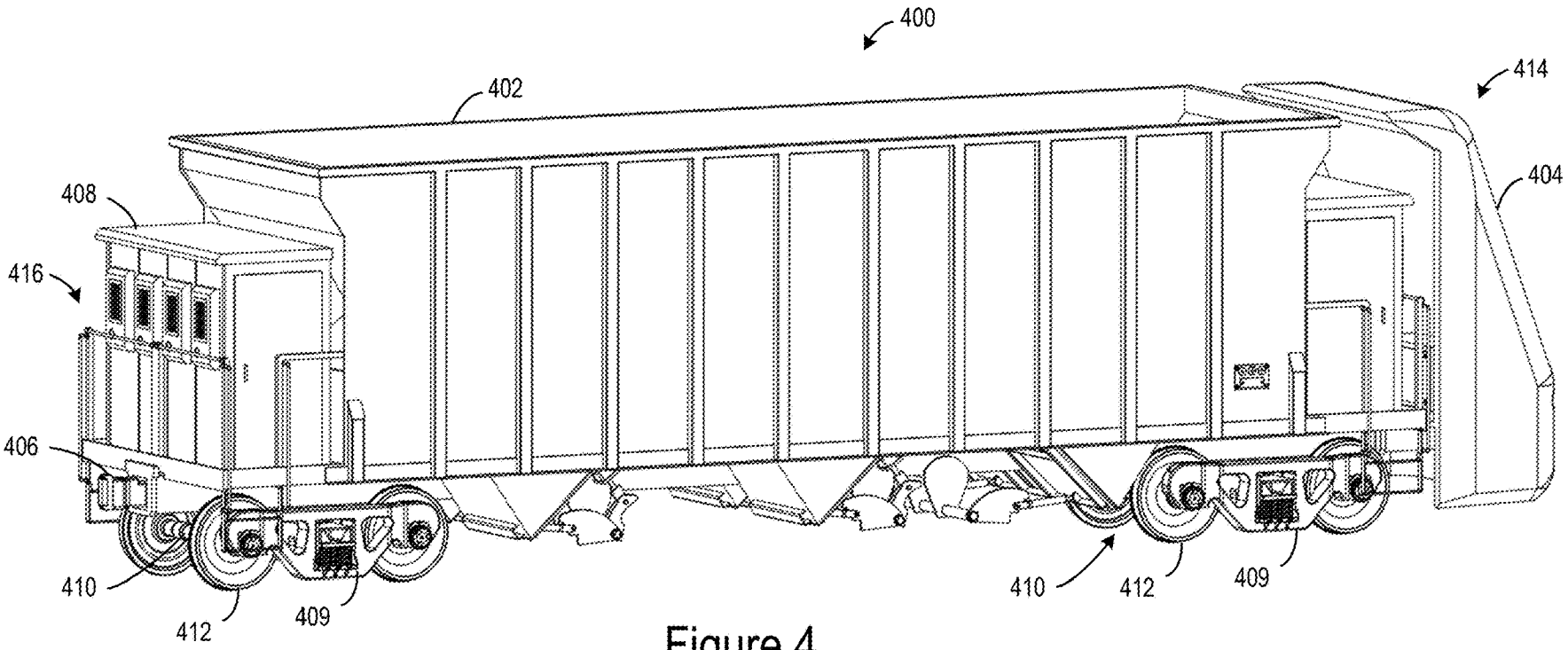
FIG. 4 is another configuration of a railway vehicle with a motive system, according to one or more example embodiments.

FIG. 4 illustrates another configuration of railway vehicle 402 configured with motive system 400, which can similarly include components of motive system 100 shown in FIG. 1 and may enable railway vehicle 402 to operate autonomously and without locomotives.

Railway vehicle 402 is similar to railway vehicle 302 shown in FIG. 3, but differs at the front end of railway vehicle 402. In particular, motive system 400 implemented on railway vehicle 402 includes sensor component 404 that may include additional sensors (e.g., cameras, radar) to enable railway vehicle 402 to perform operations typically completed by a locomotive. Railway vehicle 402 includes coupler 406 and bogies 409 configured with axles 410 and wheels 412 as shown in FIG. 4. As such, bogies 409 and disclosed bearing adapters can be used to position motors and/or other components that enable railway vehicle 402 to be self-propelled. In some examples, regenerative braking components can be attached to axles 410, bogies 409, and/or wheels 412. In addition, housing 408 may include batteries and/or other components for motive system 400. Railway vehicle 402 has front side 414 and rear side 416 as shown in FIG. 4. Rear side 416 can be coupled to another railway vehicle within a train set via coupler 406.

Figure 5:
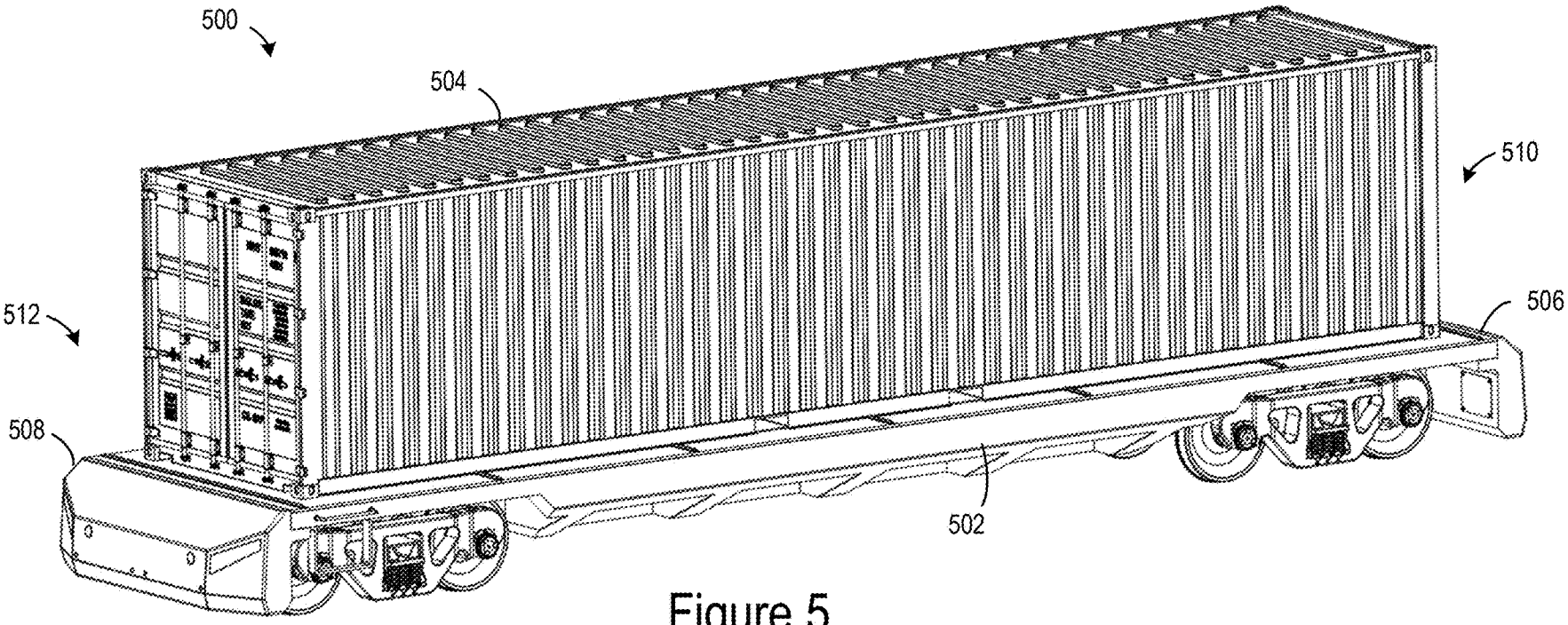
FIG. 5 is an additional configuration of a railway vehicle with a motive system, according to one or more example embodiments.

FIG. 5 illustrates an additional configuration of railway vehicle 502 configured with motive system 500, which can similarly include components of motive system 100 shown in FIG. 1 and may enable railway vehicle 502 to operate autonomously and without locomotives. Similar to the examples shown in FIG. 3 and FIG. 4, motive system 500 can include components that can enhance performance of railway vehicle 502.

In the example embodiment, railway vehicle 502 has a flat design to enable one or multiple containers (e.g., shipping container 504) to be positioned on top. Motive system 500 implemented on railway vehicle 502 includes front component 506 positioned at front side 510 and rear component 508 positioned at rear side 512. One or both of front component 506 and rear component 508 can include various components of motive system 500, such as sensors, energy storage (e.g., batteries), etc. In addition, the bogies of railway vehicle 502 can similarly include components of motive system 500, such as regenerative brakes, motors, etc. Motive system 500 can also be designed for standard coupling interfaces and may use one or multiple bearing adapters disclosed herein.

In addition, each railway vehicle 302, 402, 502 can further include additional components, such as emergency brakes, lights, and horns.

Figure 6:
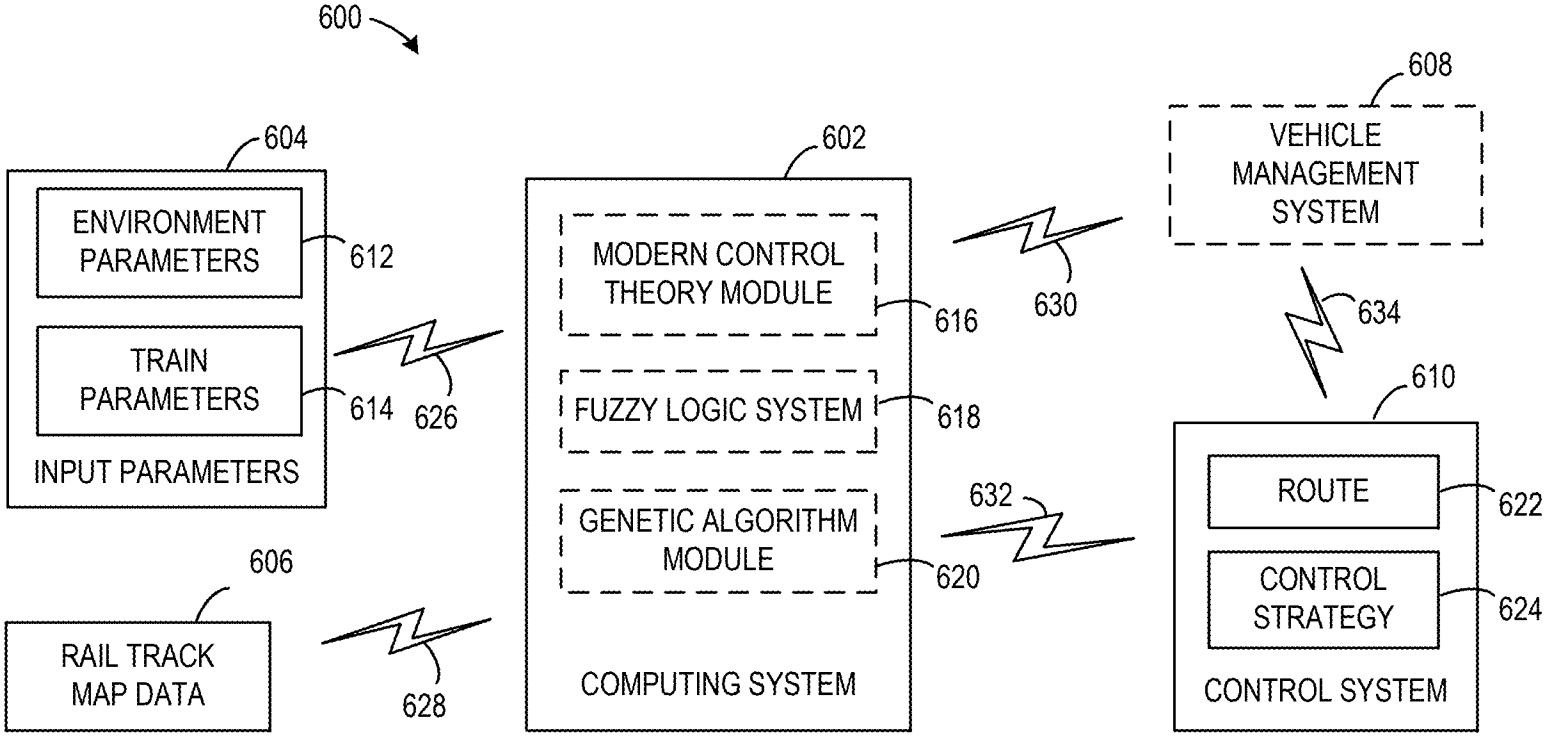
FIG. 6 is a functional block diagram of a system for implementing energy efficient route planning and control strategies for one or multiple railway vehicles, according to one or more example embodiments.

FIG. 6 is a functional block diagram of a system for implementing energy efficient route planning and control strategies for one or multiple railway vehicles. System 600 may perform operations described herein to generate and provide energy efficient routes and control strategies to railway vehicles. System 600 may also be used to modify routes and control strategies in real-time in response to detected changes in the environment, rail-network use, performance of railway vehicles or individual components, and/or other factors. In some cases, system 600 may provide information that enables a train operator to review and approve modifications to routes and/or control strategies for one or multiple railway vehicles.

In the example embodiment, system 600 includes computing system 602, vehicle management system (VMS) 608, and control system 610, but may include more or fewer components in other examples. For instance, components of system 600 may be combined, redundantly duplicated, or further divided in examples. As an example, although computing system 602 and control system 610 are shown as physically separate components within system 600 in FIG. 6, computing system 602 and control system 610 may be combined and part of the same computing system. In some cases where redundancy is a safety requirement, computing system 602, vehicle management system (VMS), and/or control system 610 may be duplicated to provide redundant operation in case of system failure. In other cases, computing system 602 may be positioned remotely from multiple control systems associated with different railway vehicles. System 600 may perform operations for a particular railway vehicle or any number of railway vehicles within examples.

As shown in FIG. 6, computing system 602 may receive and use input parameters 604 and rail track map data 606 provided by one or multiple sources to perform operations described herein. For instance, input parameters 604 and rail track map data 606 may be obtained from memory located at computing system 602, sensors on railway vehicles or infrastructure, other railway vehicles, and/or computing devices (e.g., servers). Although computing system 602 is shown as a singular component in FIG. 6, computing system 602 may represent one or multiple computing devices which can be located onboard a railway vehicle and/or remote from the railway vehicle. In some examples, computing system 602 may include a network of computing devices positioned on multiple railway vehicles that operate as part of a train. In some cases, computing system 602 may be combined with control system 610 and operate as part of the same system. In other examples, computing system 602 may communicate with control system 610 via wired or wireless communication.

Computing system 602 may obtain and use input parameters 604 and rail track map data 606 to generate outputs for use by control system 610. In particular, computing system 602 may determine and provide route 622 and control strategy 624 for the railway vehicle and/or train associated with control system 610. Input parameters 604 may represent any type of useful information that computing system 602 may use when determining routes and/or control strategies for execution by one or multiple control systems. As such, input parameters 604 may be specific to particular railway vehicles to enable system 600 to generate a customized route and control strategy specific to each type of railway vehicle or train.

Input parameters 604 may be organized into environment parameters 612 and train parameters 614. Environment parameters 612 may convey various information about the real-world environment that the railway vehicle or train may encounter during travel of the planned route. For instance, environment parameters 612 may provide information related to the grade, curvature, tunnels, speed restrictions, and safety considerations. Train parameters 614 may convey information specific to the railway vehicle or set of railway vehicles that will use or are using the planned route and control strategy determined by system 600. For instance, train parameters 614 may include information that represents the individual vehicle speed limits, the mass of a railway vehicle or train, the number of propelled railcars in the system, the type and configuration of each railway vehicle, the railway vehicle or vehicles'location and target destination, the type of cargo being carried, the availability and state of batteries used by railway vehicles, the number of locomotives in the system, and the maximum and minimum power for each locomotive vehicle.

Route 622 may be determined by system 600 using input parameters 604. As such, route 622 may represent an energy efficient route for one or multiple railway vehicles to travel to reach a target destination or multiple destinations in accordance with expectations assigned to the railway vehicles. For instance, computing system 602 may use input parameters 604, which may include a variety of data points such as the train's weight, the number of cars, weather conditions, speed restrictions, and the train's operational schedule, in conjunction with rail track map data 606 to determine an energy-efficient route for a railway vehicle. Rail track map data 606 may provide detailed information about the physical characteristics of the route, including gradients, curves, tunnels, and the location of stations and sidings. In some cases, system 600 may modify route 622 in real-time based on newly obtained information that may impact navigation of route 622.

When generating route 622, computing system 602 may initially analyze rail track map data 606 to identify potential routes and assess the energy requirements for each segment of the track based on the topography and track conditions. Computing system 602 may then apply algorithms that take into account input parameters 604 to simulate various scenarios and predict the energy consumption for different routes and driving strategies. For example, computing system 602 might calculate the energy cost of accelerating to different speeds, cruising at those speeds, and braking for stations or in response to speed restrictions. Computing system 602 may also consider dynamic factors, such as real-time weather conditions, which can affect resistance and traction, and thus energy consumption. For instance, wet or icy tracks may require more energy for traction, while strong headwinds could increase aerodynamic drag. Computing system 602 may then adjust its calculations to account for these variables, ensuring that the chosen route and speed profile remain energy-efficient under the prevailing conditions.

In addition, computing system 602 may also integrate the operational schedule into its calculations to ensure that the railway vehicle or train maintains punctuality while minimizing energy use. In some cases, computing system 602 may look for opportunities for the railway vehicle or train to coast or use regenerative braking to recover energy, especially in sections of the route where this would be beneficial, such as descending gradients. As such, computing system 602 may then output a recommended route (i.e., route 622) and speed profile (e.g., control strategy 624) that balances energy efficiency with operational constraints, ensuring that the railway vehicle or train reaches its destination on time while consuming the least amount of energy. System 600 could also provide real-time updates and adjustments to route 622 and control strategy 624 in response to changes in input parameters 604 or unforeseen events such as track obstructions or changes in weather conditions.

Computing system 602, in conjunction with control system 610, may be designed to dynamically adjust control strategy 624 for one or multiple railway vehicles based on changes in the environment, the condition of the train (or individual railway vehicles), and other relevant factors. This adaptive approach ensures that the train operates efficiently, safely, and reliably under varying conditions. For instance, when environmental changes are detected, such as shifts in weather patterns that could affect traction (like rain or snow) or resistance (such as strong winds), computing system 602 may analyze the data received from onboard sensors or external sources like weather forecasting systems. Computing system 602 may then adjust control strategy 624 to optimize energy usage while maintaining safety. For example, in adverse weather conditions, computing system 602 may reduce the train's speed to prevent slippage or increase power to the motors to compensate for increased resistance.

The condition of the train may be continuously monitored by computing system 602 and/or control system 610 through various diagnostic sensors that track the status of the train's mechanical and electrical components. If a potential issue is detected, such as overheating in the motors or abnormal wear on the brakes, computing system 602 and/or control system 610 may take preemptive action to mitigate the problem. This might involve rerouting power, adjusting the speed, or scheduling maintenance stops to address the issue before it leads to a more serious failure. In addition, computing system 602 and/or control system 610 may also take into account other factors that can influence the train's operation, such as real-time traffic conditions, track occupancy, and operational schedules. By integrating with communication systems and traffic management platforms, computing system 602 and/or control system 610 may receive updates about the position and movement of other trains, allowing system 600 to adjust the train's speed and headway to avoid congestion and ensure timely arrivals.

In some cases, system 600 can adapt to changes in the train's load, such as variations in passenger numbers or cargo weight, which can affect acceleration, braking, and energy consumption. For instance, computing system 602 and/or control system 610 may process this information to fine-tune the power output and braking force, ensuring that a railway vehicle or train operates smoothly and efficiently regardless of load changes. As such, computing system 602 and control system 610 can work in tandem to continuously assess and respond to a multitude of inputs and conditions. By leveraging advanced algorithms and real-time data, system 600 can dynamically adjust the control strategy to optimize the train's performance, ensuring that it remains energy-efficient, punctual, and safe across all operational scenarios.

Computing system 602 includes modern control theory module 616 and fuzzy logic system 618, which may be used to determine control strategy 624 for a railway vehicle, multiple railway vehicles, or train to use. In particular, computing system 602 may factor input parameters 604 and rail track map data 606 to determine control strategy 624 that specifies speed ranges for the railway vehicle(s) to use during different portions of route 622. In some cases, computing system 602 may also include genetic algorithm module 620 that may be configured to optimize fuzzy logic system 618. Genetic algorithm module 620 may encode various parameters in chromosomes and operate on these chromosomes to optimize them. This optimization may be achieved using a custom cost function, which allows computing system 602 to be trained to determine the optimum speeds for the train.

Computing system 602 may use modern control theory in conjunction with fuzzy logic to determine route 622 and adjust control strategy 624 for a railway vehicle. Modern control theory provides a mathematical framework that allows computing system 602 to model the dynamic behavior of the train and predict its response to various control inputs. This can involve creating a set of differential equations that represent the physical laws governing the train's motion, such as Newton's laws of motion, and solving these equations to predict the future states of the train under different conditions. Computing system 602 may use these predictive models to simulate various routing scenarios and control strategies, taking into account factors such as track geometry, speed limits, and the train's operational schedule. By analyzing these simulations, the system can identify the route and control strategy that minimizes energy consumption while meeting all operational constraints, such as arrival times and safety requirements.

Fuzzy logic can be incorporated by computing system 602 to handle uncertainties and vagueness in the input data that modern control theory alone may not be able to address effectively. Fuzzy logic may allow system 600 to make decisions based on approximate or incomplete information by using a set of fuzzy rules and membership functions. For example, fuzzy logic can be used to determine the appropriate speed for the train when the track conditions are not precisely known but are described in qualitative terms, such as "slippery" or "rough. " Computing system 602 may combine the precision of modern control theory with the flexibility of fuzzy logic to create a robust control system. It uses fuzzy logic to interpret sensor data and environmental inputs, which may be subject to measurement noise or inaccuracies, and then applies modern control theory to calculate the control actions that will lead to the desired outcomes.

When adjusting control strategies, computing system 602 may continuously monitor the performance of railway vehicles and the environment. If changes are detected, such as unexpected track conditions or deviations from the schedule, computing system 602 may use fuzzy logic to assess the situation and determine the degree to which control strategy 624 should be adjusted. Modern control theory is then used to implement these adjustments in a precise and efficient manner, ensuring that a train remains on the optimum route and follows the control strategy that conserves energy while maintaining safety and adherence to the schedule.

In some embodiments, system 600 may also include VMS 608. VMS 608 may be configured to provide information to a train operator. For instance, VMS 608 may alert a train operator of potential problems with the train's condition. The functionality may come from VMS 608 and not the algorithm used to determine the optimum speeds for the train. VMS 608 may alert the train operator through a user interface, which could be a touchscreen interface, a voice-controlled interface, and/or a gesture-controlled interface. In some examples, VMS 608 may include computing system 602 and control system 610.

In some cases, the real-time data about the train's condition used by system 600 may include the status of the train's engine or brakes. For example, if the engine is overheating or the brakes are worn out, control system 610 may reduce the train's speed to prevent damage or failure. This real-time data can be obtained from various sensors installed on the train, and can be processed by computing system 602 and/or control system 610 to adjust the train's speed in real-time. This allows control system 610 to respond quickly to changes in the train's condition, further enhancing its energy efficiency and safety.

In some aspects, modern control theory module 616 and fuzzy logic system 618 may be further configured to adapt to changes in the input data. For instance, changes in the stopping distance or weight of a railway vehicle or the train may be taken into account. The stopping distance of a train can vary based on factors such as the train's speed, the condition of the brakes, and the condition of the track. Similarly, the weight of the train can change depending on the number of railcars, the load in each railcar, and the weight of the locomotives. By adapting to these changes in real-time, control system 610 may be able to adjust the train's speed to maintain optimum energy efficiency and safety. For example, if the stopping distance increases due to wet tracks, control system 610 may reduce the train's speed to ensure it can stop safely. Similarly, if the weight of the train increases due to additional railcars, control system 610 may adjust the train's speed to maintain energy efficiency.

In some embodiments, system 600 may be further configured to integrate with other systems, such as a Global Positioning System (GPS) or a weather forecasting system. The integration with a GPS system may provide more accurate data about the train's location and speed, which can be used by system 600 to determine the optimum speeds for the train. For instance, if the train is approaching a curve or a steep grade, the control system may reduce the train's speed to ensure safety and energy efficiency. Similarly, if the train is running behind schedule, control system 610 may increase the train's speed to make up for lost time, provided it can do so without compromising safety or energy efficiency.

In some cases, system 600 may also integrate with a weather forecasting system to get real-time data about the weather conditions, which can affect the train's speed and energy efficiency. For example, if the weather forecasting system predicts heavy rain or snow, control system 610 may reduce the train's speed to maintain safety and energy efficiency. Conversely, if the weather forecasting system predicts clear and dry conditions, control system 610 may increase the train's speed to take advantage of the favorable conditions. By integrating with a weather forecasting system, control system 610 may be able to adjust the train's speed in response to changing weather conditions, further enhancing its energy efficiency and safety.

System 600 may be configured to optimize the use of battery power, ensuring that the railcars can operate efficiently and sustainably. For instance, system 600 may adjust the train's speed to minimize power consumption, while still maintaining safety and meeting the train's operational requirements. This may help to extend the battery life and reduce the frequency of charging, making the railcars more practical and convenient for both short-distance and long-distance travel. In some cases, control system 610 may be specifically designed for battery-operated self-propelled railcars. This specific design may take into account the particular characteristics and requirements of these railcars. For example, the control system may consider the capacity and discharge rate of the batteries, the power requirements of the railcars, and the energy regeneration capabilities of the railcars during braking or downhill travel. By considering these factors, system 600 may be able to determine the optimum speeds for the railcars that balance energy efficiency, safety, and operational performance. This specific design may make the control system particularly effective and beneficial for battery-operated self-propelled railcars.

In some embodiments, system 600 may be designed to operate passively, requiring no interaction from a trainer operator or another user. This design feature may enhance the usability and efficiency of system 600. For instance, once system 600 is activated, computing system 602 and other components may automatically receive and process the input data, determine the optimum speeds for the train, and adjust the train's speed accordingly, all without requiring any input or intervention from the user. This passive operation may reduce the workload for the train operator and minimize the risk of human error, leading to more reliable and efficient operation of the train. Furthermore, the passive operation of the control system may allow it to continuously monitor and respond to changes in the input data and the train's condition, ensuring optimum energy efficiency and safety at all times.

Figure 7:
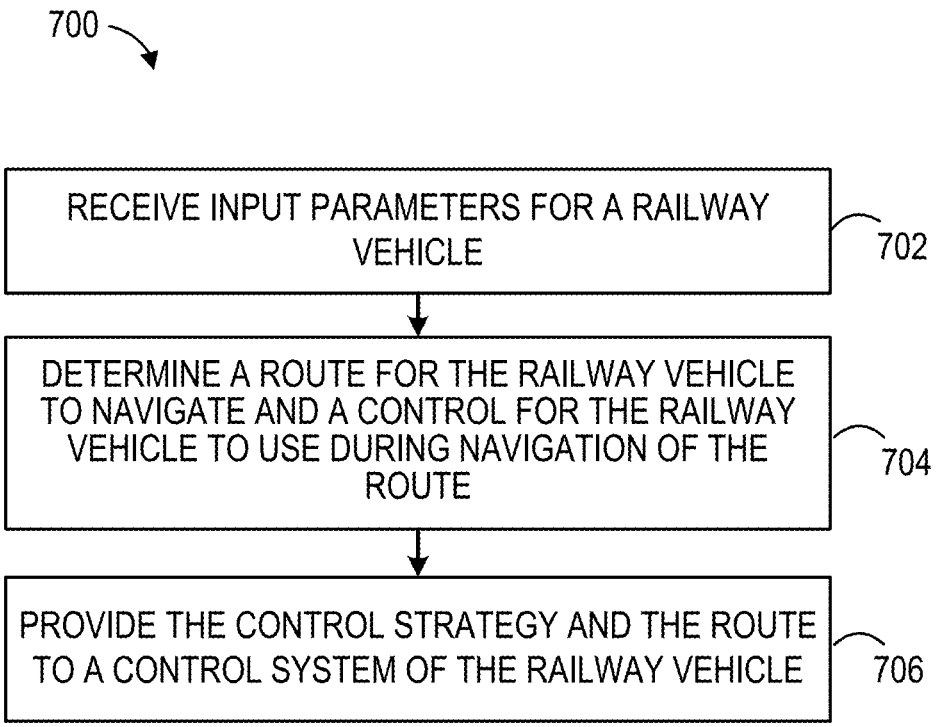
FIG. 7 is a flowchart of a method for implementing energy efficient route planning and control strategies for one or multiple railway vehicles, according to one or more example embodiments.

FIG. 7 is a flowchart of a method for determining an energy efficient route and control strategy for one or multiple railway vehicles. Method 700 represents an example method that may include one or more operations, functions, or actions, as depicted by one or more of blocks 702, 704, and 706, each of which may be carried out by any of the systems, devices, and/or vehicles shown in FIGS. 1-6, among other possible systems.

Those skilled in the art will understand that the flowcharts described herein illustrate functionality and operations of certain implementations of the present disclosure. In this regard, each block of the various flowcharts may represent a module, a segment, or a portion of program code, which includes one or more instructions executable by one or more processors for implementing specific logical functions or steps in the process. The program code may be stored on any type of computer readable medium, for example, such as a storage device including a disk or hard drive.

In addition, each block may represent circuitry that is wired to perform the specific logical functions in the process. Alternative implementations are included within the scope of the example implementations of the present application in which functions may be executed out of order from that shown or discussed, including substantially concurrent or in reverse order, depending on the functionality involved, as may be understood by those reasonably skilled in the art.

At block 702, method 700 involves receiving input parameters for a railway vehicle. A computing system performing method 700 may obtain input parameters for one or multiple railway vehicles. The input parameters may indicate a current location of the railway vehicle, a target destination for the railway vehicle, and one or more physical attributes corresponding to the railway vehicle. The input parameters can convey other information, including factors that can influence a railway vehicle's energy consumption and operation efficiency.

Input parameters can vary within examples and may include information related to vehicle specifications, state of charge, operational requirements, mass, length, and height, etc. Vehicle specifications, such as the mass of the railway vehicle, aerodynamic properties, rolling resistance, and mechanical efficiency. State of charge can include information that represents In some examples, the computing system may obtain topography parameters that represent the gradient and elevation changes along potential routes. The topography parameters may be used by the computing system to analyze the potential amount of energy that the railway vehicle or vehicles may use for climbing hills or the potential for energy regeneration during descent. The computing system may also obtain track condition parameters that indicate the curvature of the available tracks, track quality, and presence of switches or crossings that may require speed adjustments. Similarly, the computing system may also receive speed restriction parameters that articulate legal and safety-related speed limits for different sections of potential routes.

In some examples, the computing system may obtain environment parameters, such as weather condition parameters that can be utilized when determining routes and control strategies for railway vehicles. Wind speed and direction, temperature, precipitation, and other weather-related factors that can impact resistance and traction may be analyzed by the computing system.

At block 704, method 700 involves determining a route for the railway vehicle to navigate and a control strategy for the railway vehicle to use during navigation of the route. The computing system may determine the route and the control strategy based on the input parameters and railway map data. The control strategy may associate a speed range with one or more portions of the route for the railway vehicle to use during navigation of the route.

At block 706, method 700 involves providing, by the computing system, the control strategy and the route to a control system of the railway vehicle. The control system is configured to control the railway vehicle according to the control strategy during navigation of the route.

In some examples, the computing system determines, using a model, one or more speed ranges for the railway vehicle to use to navigate the route. The model may be generated based on a combination of modern control theory and a fuzzy logic system. In some cases, the fuzzy logic system is optimized using a genetic algorithm prior to generation of the model.

In some cases, method 700 may further involve receiving, during navigation of the route, sensor data representing an environment of at least one railway vehicle and detecting, based on the sensor data, a potential obstacle in the environment. The computing system may then provide an alert representing the potential obstacle to an operator via a VMS based on detecting the potential obstacle.

In some examples, method 700 may further involve receiving, during navigation of the route, sensor data representing a change in a condition of the at least one railway vehicle and modifying the control strategy based on the change in the condition of the at least one railway vehicle.

In some cases, the computing system is coupled to the railway vehicle and the railway vehicle is a freight railway vehicle retrofitted with one or more motors coupled to a battery system. The computing system may receive, during navigation of the route, real-time control parameters for the railway vehicle. The real-time control parameters provide information about the one or more motors, the battery system, and a braking system of the railway vehicle. The computing system may then modify the control strategy for the railway vehicle based on the real-time control parameters. In some examples, method 700 may further involve monitoring, based on the real-time control parameters, a state of the battery system. The computing system may modify the control strategy based on the state of the battery system.

In some examples, method 700 may further involve receiving sensor data corresponding to a coupler positioned between a first railway vehicle and a second railway vehicle. For instance, the sensor data may represent the force on the coupler, which may represent the distance between the first railway vehicle and the second railway vehicle. As such, the computing system may adjust the control strategy for the first railway vehicle and the second railway vehicle based on the sensor data corresponding to the coupler.

In some examples, the input parameters indicate weather conditions for one or more locations between the current location of the railway vehicle and the target destination. The computing system may then determine the control strategy further based on the weather conditions for the one or more locations between the current location of the railway vehicle and the target destination.

In some examples, the computing system may receive sensor data from one or more sensors coupled to the railway vehicle and detect a change in a condition of the railway vehicle or an environment of the railway vehicle based on the sensor data. The computing system may then modify the control strategy to adjust one or more speed ranges or a stopping distance used by at least one railway vehicle.

In some examples, the computing system may cause the control system to autonomously control the railway vehicle during navigation of the route according to the control strategy while monitoring for one or more changes in an environment of the railway vehicle or condition of the railway vehicle.

In some cases, the computing system is positioned remotely from the railway vehicle and provides the control strategy and the route to the control system via wireless communication.

In some examples, the computing system may receive input parameters corresponding to a set of railway vehicles that are coupled together to form a train. The set of railway vehicles include at least a first freight railway vehicle retrofitted with a first motor and a first battery system and a second freight railway vehicle retrofitted with a second motor and a second battery system. The input parameters corresponding to the set of railway vehicles includes a quantity of railway vehicles that form the train and respective power ratings for the first motor and the second motor.

In some examples, the computing system may receive weather data for one or more locations positioned along the route. For instance, the computing system may communicate with an external weather system and/or onboard weather sensors. The computing system may then modify the route or the control strategy for the railway vehicle based on the weather data.

In some examples, the method may involve receiving input parameters related to the physical specifications and system specifications of a train. These parameters may include, but are not limited to, the grade, curvature, tunnels, speed restrictions, safety considerations, speed limits, the mass of the system, the number of propelled railcars in the system, the number of locomotives in the system, and the maximum and minimum power for each locomotive vehicle. In some cases, the method may involve determining optimum speeds for the train based on the input parameters. This determination may be made using a combination of modern control theory and a fuzzy logic system. The modern control theory may be used to simulate a locomotive, providing an input to the fuzzy logic system. The fuzzy logic system may then be used to handle the energy application and recovery, determining the optimum speeds for the train.

In some embodiments, the method may involve optimizing the fuzzy logic system using a genetic algorithm. The genetic algorithm may encode various parameters in chromosomes and operate on these chromosomes to optimize them. This optimization may be achieved using a custom cost function, which allows the system to be "trained" to determine the optimum speeds for the train. The genetic algorithm may operate on parameters of the controller, allowing these parameters to be adjusted to accommodate different stopping distances or weights.

In some aspects, the method may involve alerting a train operator of potential problems through a VMS. The VMS may be configured to alert the train operator of potential problems with the train's condition. This functionality may come from the VMS and not the algorithm used to determine the optimum speeds for the train. The VMS may alert the train operator through a user interface, which could be a touchscreen interface, a voice-controlled interface, or a gesture-controlled interface.

In some aspects, the method for controlling self-propelled rail cars may further consider additional input parameters. These parameters may include weather conditions and real-time data about the train's condition. Weather conditions can have a substantial impact on the train's speed and energy efficiency. For instance, heavy rain or snow can reduce traction and increase the stopping distance, while high winds can increase air resistance and reduce the train's speed. Therefore, by taking weather conditions into account, the method may be able to adjust the train's speed to maintain energy efficiency and safety under different weather conditions.

In some cases, the real-time data about the train's condition may include the status of the train's engine or brakes. For example, if the engine is overheating or the brakes are worn out, the method may reduce the train's speed to prevent damage or failure. This real-time data can be obtained from various sensors installed on the train, and can be processed by the control system to adjust the train's speed in real-time. This allows the method to respond quickly to changes in the train's condition, further enhancing its energy efficiency and safety.

In some aspects, the method for controlling self-propelled rail cars may be designed to adapt to changes in the input data. For instance, changes in the stopping distance or weight of the train may be taken into account. The stopping distance of a train can vary based on factors such as the train's speed, the condition of the brakes, and the condition of the track. Similarly, the weight of the train can change depending on the number of railcars, the load in each railcar, and the weight of the locomotives. By adapting to these changes in real-time, the method may be able to adjust the train's speed to maintain optimum energy efficiency and safety. For example, if the stopping distance increases due to wet tracks, the method may reduce the train's speed to ensure it can stop safely. Similarly, if the weight of the train increases due to additional railcars, the method may adjust the train's speed to maintain energy efficiency.

In some embodiments, the method for controlling self-propelled rail cars may further involve integrating with other systems, such as a Global Positioning System (GPS). The integration with a GPS system may provide more accurate data about the train's location and speed, which can be used by the control system to determine the optimum speeds for the train. For instance, if the train is approaching a curve or a steep grade, the method may reduce the train's speed to ensure safety and energy efficiency. Similarly, if the train is running behind schedule, the method may increase the train's speed to make up for lost time, provided it can do so without compromising safety or energy efficiency.

In some cases, the method may also integrate with a weather forecasting system. This integration may allow the method to get real-time data about the weather conditions, which can affect the train's speed and energy efficiency. For example, if the weather forecasting system predicts heavy rain or snow, the method may reduce the train's speed to maintain safety and energy efficiency. Conversely, if the weather forecasting system predicts clear and dry conditions, the method may increase the train's speed to take advantage of the favorable conditions. By integrating with a weather forecasting system, the method may be able to adjust the train's speed in response to changing weather conditions, further enhancing its energy efficiency and safety.

In some embodiments, the train that the method is controlling may be a battery-operated vehicle. This type of vehicle may be particularly suitable for the method due to its reliance on electrical power, which can be efficiently managed and optimized by the control system. For instance, the method may adjust the train's speed to minimize power consumption, while still maintaining safety and meeting the train's operational requirements. This may help to extend the battery life and reduce the frequency of charging, making the railcars more practical and convenient for both short-distance and long-distance travel. In some cases, the battery-operated vehicle may be a self-propelled railcar, which uses batteries as its primary source of power. The method may be particularly effective for these types of vehicles, as it can optimize the use of battery power and ensure efficient and sustainable operation.

In some aspects, the method for controlling self-propelled rail cars may operate passively, requiring no interaction from the user. This passive operation may be a feature of the control system that enhances its usability and efficiency. Once the control system is activated, it may automatically receive and process the input data, determine the optimum speeds for the train, and adjust the train's speed accordingly, all without requiring any input or intervention from the user. This passive operation may reduce the workload for the train operator and minimize the risk of human error, leading to more reliable and efficient operation of the train. Furthermore, the passive operation of the control system may allow it to continuously monitor and respond to changes in the input data and the train's condition, ensuring optimum energy efficiency and safety at all times.

In some aspects, the control system may be specifically designed for battery-operated self-propelled railcars. This specific design may include a battery management module configured to maintain the battery charge over time. The battery management module may monitor the state of charge of the battery and adjust the operation of the system to maintain the battery charge over time. This may help to extend the battery life and reduce the frequency of charging, making the railcars more practical and convenient for both short-distance and long-distance travel.

In some cases, the modern control theory module and the fuzzy logic system module may be further configured to adapt to changes in the input data, such as changes in the stopping distance or weight of the train. This adaptability may allow the control system to adjust the train's speed in real-time to maintain optimum energy efficiency and safety, even as the conditions change.

In some examples, the control system could use different types of control algorithms to determine the optimum speeds for the train. For example, it could use machine learning algorithms, neural network algorithms, or reinforcement learning algorithms. These different types of algorithms could provide different benefits, such as improved adaptability to changing conditions or improved prediction of future states. In addition, the control system could use different types of sensor systems to gather the input data. For example, it could use radar sensors, lidar sensors, or ultrasonic sensors. These different types of sensors could provide different benefits, such as improved accuracy or increased range.

The control system could use different data processing techniques to analyze the input data and determine the optimum speeds for the train. For example, it could use statistical methods, data mining techniques, or big data analytics. These different techniques could provide different benefits, such as improved data analysis or increased speed of data processing. In some cases, the control system could use different communication protocols to exchange data with other systems or devices. For example, it could use Wi-Fi, Bluetooth, or cellular networks to communicate with a GPS system or a weather forecasting system. It could also use wired communication protocols, such as Ethernet or USB, to connect with onboard devices or systems.

The control system could use different energy management techniques to maintain the battery charge over time. For example, it could use energy harvesting techniques, such as solar power or regenerative braking, to recharge the battery. It could also use energy storage techniques, such as supercapacitors or flywheels, to store excess energy for later use. The control system could include different safety mechanisms to ensure the safe operation of the train. For example, it could include an emergency braking system, a collision avoidance system, or a derailment prevention system. These different mechanisms could provide different benefits, such as improved safety or increased reliability.

The control system could have different types of user interfaces. For example, it could have a graphical user interface, a text-based interface, or a virtual reality interface. These different types of interfaces could make the system easier to use and more accessible to different types of users.

The above detailed description describes various features and functions of the disclosed systems, devices, and methods with reference to the accompanying figures. While various aspects and embodiments have been disclosed herein, other aspects and embodiments will be apparent. The various aspects and embodiments disclosed herein are for purposes of illustration and are not intended to be limiting, with the true scope being indicated by the following claims.

It should be understood that arrangements described herein are for purposes of example only. As such, those skilled in the art will appreciate that other arrangements and other elements (e.g. machines, apparatuses, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

What is claimed is:

1. A method comprising:

receiving, at a computing system, a plurality of input parameters for at least one railway vehicle, wherein the plurality of input parameters indicates a current location of the at least one railway vehicle, a target destination for the at least one railway vehicle, and one or more physical attribute corresponding to the at least one railway vehicle;

determining, based on the plurality of input parameters and railway map data, a route for the at least one railway vehicle to navigate and a control strategy for the at least one railway vehicle to use during navigation of the route, wherein the control strategy associates a speed range with one or more portions of the route for the at least one railway vehicle to use during navigation of the route, and wherein determining the control strategy comprises determining. using a model generated based on a combination of modern control theory and a fuzzy logic system, one or more speed ranges for the at least one railway vehicle to use to navigate the route; and providing, by the computing system, the control strategy and the route to a control system of the at least one railway vehicle, wherein the control system is configured to control the at least one railway vehicle according to the control strategy during navigation of the route.

2. The method of claim 1, wherein the fuzzy logic system is optimized using a genetic algorithm prior to generation of the model.

3. The method of claim 1, further comprising:

receiving, during navigation of the route, sensor data representing an environment of the at least one railway vehicle;

detecting, based on the sensor data, a potential obstacle in the environment; and based on detecting the potential obstacle, providing an alert representing the potential obstacle to an operator via a Vehicle Management System (VMS).

4. The method of claim 1, further comprising:

receiving, during navigation of the route, sensor data representing a change in a condition of the at least one railway vehicle; and modifying the control strategy based on the change in the condition of the at least one railway vehicle.

5. The method of claim 1, wherein the computing system is coupled to the at least one railway vehicle, and wherein the at least one railway vehicle is a freight railway vehicle retrofitted with one or more motors coupled to a battery system.

6. The method of claim 5, further comprising:

receiving, during navigation of the route, real-time control parameters for the at least one railway vehicle, wherein the real-time control parameters provide information about the one or more motors, the battery system, and a braking system of the at least one railway vehicle; and modifying the control strategy for the at least one railway vehicle based on the real-time control parameters.

7. The method of claim 6, further comprising:

monitoring, based on the real-time control parameters, a state of the battery system; and wherein modifying the control strategy for the at least one railway vehicle comprises:

modifying the control strategy based on the state of the battery system.

8. The method of claim 1, wherein the plurality of input parameters indicates weather conditions for one or more locations between the current location of the at least one railway vehicle and the target destination; and wherein determining the control strategy for the at least one railway vehicle to use to navigate the route comprises:

determining the control strategy further based on the weather conditions for the one or more locations between the current location of the at least one railway vehicle and the target destination.

9. The method of claim 1, further comprising:

receiving sensor data from one or more sensors coupled to the at least one railway vehicle;

detecting a change in a condition of the at least one railway vehicle or an environment of the at least one railway vehicle; and modifying the control strategy to adjust one or more speed ranges or a stopping distance used by the at least one railway vehicle.

10. The method of claim 1, wherein providing the control strategy and the route to the control system of the at least one railway vehicle comprises:

causing the control system to autonomously control the at least one railway vehicle during navigation of the route according to the control strategy while monitoring for one or more changes in an environment of the at least one railway vehicle or condition of the at least one railway vehicle.

11. The method of claim 1, wherein the computing system is positioned remotely from the at least one railway vehicle; and wherein providing the control strategy and the route to the control system of the at least one railway vehicle comprises:

providing the control strategy and the route to the control system via wireless communication.

12. The method of claim 1, wherein receiving the plurality of input parameters for at least one railway vehicle comprises:

receiving the plurality of input parameters corresponding to a set of railway vehicles, wherein the set of railway vehicles are coupled together to form a train, and wherein the set of railway vehicles comprises at least a first freight railway vehicle retrofitted with a first motor and a first battery system and a second freight railway vehicle retrofitted with a second motor and a second battery system.

13. The method of claim 12, wherein the plurality of input parameters corresponding to the set of railway vehicles includes a quantity of railway vehicles that form the train and respective power ratings for the first motor and the second motor.

14. The method of claim 1, further comprising:

receiving weather data for one or more locations positioned along the route; and modifying the route or the control strategy for the at least one railway vehicle based on the weather data.

15. The method of claim 1, further comprising:

receiving sensor data corresponding to a coupler positioned between a first railway vehicle and a second railway vehicle; and adjusting the control strategy for the first railway vehicle and the second railway vehicle based on the sensor data corresponding to the coupler.

16. A system comprising:

a memory configured to store railway map data; and a computing system configured to:

receive a plurality of input parameters for at least one railway vehicle, wherein the plurality of input parameters indicates a current location of the at least one railway vehicle, a target destination for the at least one railway vehicle, and one or more physical attribute corresponding to the at least one railway vehicle;

determine, based on the plurality of input parameters and railway map data, a route for the at least one railway vehicle to navigate and a control strategy for the at least one railway vehicle to use during navigation of the route, wherein the control strategy associates a speed range with one or more portions of the route for the at least one railway vehicle to use during navigation of the route, and wherein the computing system is configured to determine the control strategy using a model generated based on a combination of modern control theory and a fuzzy logic system to determine one or more speed ranges for the at least one railway vehicle to use to navigate the route; and provide the control strategy and the route to a control system of the at least one railway vehicle, wherein the control system is configured to control the at least one railway vehicle according to the control strategy during navigation of the route.

17. The system of claim 16, wherein the fuzzy logic system is optimized using a genetic algorithm prior to generation of the model.

18. A non-transitory computer readable medium configured to store instructions, that when executed by a computing system comprising one or more processors, causes the computing system to perform operations comprising:

receiving a plurality of input parameters for at least one railway vehicle, wherein the plurality of input parameters indicates a current location of the at least one railway vehicle, a target destination for the at least one railway vehicle, and one or more physical attribute corresponding to the at least one railway vehicle;

determining, based on the plurality of input parameters and railway map data, a route for the at least one railway vehicle to navigate and a control strategy for the at least one railway vehicle to use during navigation of the route, wherein the control strategy associates a speed range with one or more portions of the route for the at least one railway vehicle to use during navigation of the route, and wherein determining the control strategy comprises determining. using a model generated based on a combination of modern control theory and a fuzzy logic system, one or more speed ranges for the at least one railway vehicle to use to navigate the route; and providing the control strategy and the route to a control system of the at least one railway vehicle, wherein the control system is configured to control the at least one railway vehicle according to the control strategy during navigation of the route.

* * * * *